US009664016B2

(12) United States Patent
Harris et al.

(10) Patent No.: US 9,664,016 B2
(45) Date of Patent: May 30, 2017

(54) ACOUSTIC ARTIFICIAL LIFT SYSTEM FOR GAS PRODUCTION WELL DELIQUIFICATION

(71) Applicants: Dennis J. Harris, Houston, TX (US); Laurence T. Wisniewski, Houston, TX (US); Abbas Arian, Houston, TX (US); Randall B. Jones, Sugar Land, TX (US); Georgios L. Varsamis, Houston, TX (US)

(72) Inventors: Dennis J. Harris, Houston, TX (US); Laurence T. Wisniewski, Houston, TX (US); Abbas Arian, Houston, TX (US); Randall B. Jones, Sugar Land, TX (US); Georgios L. Varsamis, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 14/208,972

(22) Filed: Mar. 13, 2014

(65) Prior Publication Data

US 2014/0262230 A1 Sep. 18, 2014

Related U.S. Application Data

(63) Continuation-in-part of application No. 13/842,211, filed on Mar. 15, 2013.

(51) Int. Cl.
*E21B 43/12* (2006.01)

(52) U.S. Cl.
CPC ..... *E21B 43/124* (2013.01)

(58) Field of Classification Search
CPC ..... E21B 43/124
See application file for complete search history.

(56) References Cited

U.S. PATENT DOCUMENTS

| | | | |
|---|---|---|---|
| 2,444,912 | A | 7/1948 | Bodine, Jr. |
| 2,700,422 | A | 1/1955 | Bodine, Jr. |
| 2,953,095 | A | 9/1960 | Bodine, Jr. |
| 3,303,782 | A | 2/1967 | Bodine, Jr. |
| 3,583,677 | A | 6/1971 | Phillips |

(Continued)

FOREIGN PATENT DOCUMENTS

| | | | |
|---|---|---|---|
| CN | 1305047 | A | 7/2001 |
| CN | 1112503 | C | 6/2003 |

(Continued)

OTHER PUBLICATIONS

International Search Report for PCT/US2014/026293 dated Jul. 17, 2014, 2 pages.

(Continued)

*Primary Examiner* — Zakiya W Bates
*Assistant Examiner* — Crystal J Miller

(57) ABSTRACT

The artificial lift system comprises a downhole tool suspended by a power conductive cable in a wellbore. The downhole tool comprises an atomizing chamber for conversion of the liquid into droplets having an average diameter less than or equal to 10,000 microns. Natural gas produced by a producing zone of the subterranean reservoir transports the vaporized liquid molecules to the well surface. In operation, the atomizing chamber is located above the liquid column in the wellbore.

27 Claims, 10 Drawing Sheets

(56) References Cited

U.S. PATENT DOCUMENTS

| | | | | |
|---|---|---|---|---|
| 3,648,769 | A | 3/1972 | Sawyer | |
| 3,860,173 | A | 1/1975 | Sata | |
| 3,990,512 | A | 11/1976 | Kuris | |
| 4,019,683 | A * | 4/1977 | Asai | B05B 17/0623 239/102.2 |
| 4,085,893 | A * | 4/1978 | Durley, III | 239/102.2 |
| 4,153,201 | A | 5/1979 | Berger | |
| 4,280,557 | A | 7/1981 | Bodine | |
| 4,295,799 | A | 10/1981 | Bentley | |
| 4,337,896 | A | 7/1982 | Berger | |
| 4,341,505 | A | 7/1982 | Bentley | |
| 4,398,870 | A | 8/1983 | Bentley | |
| 4,632,311 | A * | 12/1986 | Nakane et al. | 239/101 |
| 4,687,420 | A | 8/1987 | Bentley | |
| 4,747,920 | A | 5/1988 | Muralidhara et al. | |
| 5,184,678 | A | 2/1993 | Pechkov et al. | |
| 5,219,120 | A | 6/1993 | Ehrenberg | |
| 5,370,317 | A * | 12/1994 | Weston | 239/533.14 |
| 5,595,243 | A | 1/1997 | Maki, Jr. et al. | |
| 5,706,892 | A | 1/1998 | Aeschbacher, Jr. et al. | |
| 5,753,812 | A | 5/1998 | Aron et al. | |
| 5,829,530 | A | 11/1998 | Nolen | |
| 5,994,818 | A | 11/1999 | Abramov et al. | |
| 6,059,040 | A * | 5/2000 | Levitan et al. | 166/372 |
| 6,186,228 | B1 * | 2/2001 | Wegener | E21B 43/003 166/177.2 |
| 6,196,312 | B1 | 3/2001 | Collins | |
| 6,279,653 | B1 | 8/2001 | Wegener et al. | |
| 6,382,321 | B1 * | 5/2002 | Bates et al. | 166/372 |
| 6,405,796 | B1 | 6/2002 | Meyer et al. | |
| 6,429,575 | B1 | 8/2002 | Abramov et al. | |
| 6,619,394 | B2 * | 9/2003 | Soliman et al. | 166/249 |
| 6,830,108 | B2 | 12/2004 | Rogers, Jr. | |
| 7,063,144 | B2 | 6/2006 | Abramov et al. | |
| 7,135,155 | B1 * | 11/2006 | Long et al. | 422/224 |
| 7,287,597 | B2 * | 10/2007 | Shaposhnikov et al. | 166/372 |
| 7,422,064 | B1 | 9/2008 | Yang | |
| 7,503,950 | B2 | 3/2009 | Håland | |
| 7,506,690 | B2 | 3/2009 | Kelley | |
| 7,717,182 | B2 * | 5/2010 | Butler et al. | 166/372 |
| 7,784,538 | B2 * | 8/2010 | McCoy | E21B 43/121 166/105 |
| 7,790,002 | B2 | 9/2010 | Penrose | |
| 8,011,901 | B2 | 9/2011 | Duncan | |
| 8,069,914 | B2 | 12/2011 | Groves | |
| 8,113,278 | B2 * | 2/2012 | DeLaCroix et al. | 166/249 |
| 8,122,962 | B2 | 2/2012 | Croteau | |
| 8,122,966 | B2 | 2/2012 | Kelley | |
| 8,261,834 | B2 * | 9/2012 | Eslinger | 166/308.1 |
| 8,297,363 | B2 * | 10/2012 | Kenworthy et al. | 166/372 |
| 8,302,695 | B2 | 11/2012 | Simpson | |
| 8,316,950 | B2 | 11/2012 | Rodriguez | |
| 8,382,375 | B2 | 2/2013 | Prieto | |
| 8,511,390 | B2 | 8/2013 | Coyle | |
| 8,560,268 | B2 | 10/2013 | Smithson | |
| 8,584,747 | B2 * | 11/2013 | Eslinger | 166/249 |
| 8,613,312 | B2 * | 12/2013 | Zolezzi-Garreton | 166/248 |
| 8,657,940 | B2 | 2/2014 | Aarebrot | |
| 8,746,333 | B2 | 6/2014 | Zolezzi-Garreton | |
| 8,931,587 | B2 | 1/2015 | Chelminski | |
| 2003/0042018 | A1 | 3/2003 | Huh et al. | |
| 2004/0216886 | A1 | 11/2004 | Rogers, Jr. | |
| 2005/0022998 | A1 | 2/2005 | Rogers | |
| 2005/0161258 | A1 | 7/2005 | Lockerd, Sr. et al. | |
| 2005/0252837 | A1 | 11/2005 | Haland | |
| 2006/0054329 | A1 | 3/2006 | Chisholm | |
| 2006/0213652 | A1 * | 9/2006 | Shaposhnikov et al. | 166/68 |
| 2007/0000663 | A1 | 1/2007 | Kelley | |
| 2007/0221383 | A1 * | 9/2007 | Mason et al. | 166/372 |
| 2008/0063544 | A1 | 3/2008 | Duncan | |
| 2008/0080990 | A1 | 4/2008 | Duncan | |
| 2008/0105426 | A1 | 5/2008 | Di et al. | |
| 2008/0121391 | A1 | 5/2008 | Durham | |
| 2008/0217009 | A1 | 9/2008 | Yang | |
| 2008/0270328 | A1 | 10/2008 | Lafferty | |
| 2009/0145608 | A1 | 6/2009 | Croteau | |
| 2009/0211753 | A1 | 8/2009 | Emtiazian | |
| 2009/0321083 | A1 | 12/2009 | Schinagl | |
| 2010/0101787 | A1 | 4/2010 | McCoy et al. | |
| 2010/0101798 | A1 | 4/2010 | Simpson et al. | |
| 2010/0252271 | A1 | 10/2010 | Kelley | |
| 2010/0294506 | A1 | 11/2010 | Rodriguez | |
| 2011/0011576 | A1 * | 1/2011 | Cavender et al. | 166/177.1 |
| 2011/0072975 | A1 | 3/2011 | Aarebrot | |
| 2011/0127031 | A1 | 6/2011 | Zolezzi Garreton | |
| 2011/0139440 | A1 | 6/2011 | Zolezzi-Garreton | |
| 2011/0139441 | A1 | 6/2011 | Zolezzi Garreton | |
| 2011/0155378 | A1 | 6/2011 | Cabanilla | |
| 2011/0182535 | A1 | 7/2011 | Prieto | |
| 2011/0186302 | A1 | 8/2011 | Coyle | |
| 2011/0209879 | A1 | 9/2011 | Quigley | |
| 2011/0247831 | A1 | 10/2011 | Smith et al. | |
| 2012/0012333 | A1 | 1/2012 | Quigley | |
| 2012/0046866 | A1 | 2/2012 | Meyer et al. | |
| 2012/0084055 | A1 | 4/2012 | Smithson | |
| 2013/0029883 | A1 | 1/2013 | Dismuke | |
| 2013/0071262 | A1 | 3/2013 | Green | |
| 2013/0175030 | A1 | 7/2013 | Ige et al. | |
| 2013/0299181 | A1 | 11/2013 | Coyle | |
| 2013/0299182 | A1 | 11/2013 | Coyle | |
| 2013/0319661 | A1 | 12/2013 | Xiao | |
| 2014/0174734 | A1 | 6/2014 | Gill | |
| 2014/0262229 | A1 * | 9/2014 | Harris | 166/249 |
| 2014/0262230 | A1 | 9/2014 | Harris | |
| 2015/0027693 | A1 * | 1/2015 | Edwards et al. | 166/250.03 |

FOREIGN PATENT DOCUMENTS

| | | | |
|---|---|---|---|
| CN | 1321257 | C | 6/2007 |
| CN | 100460626 | C | 2/2009 |
| WO | 2011064375 | A2 | 6/2011 |
| WO | 2011070143 | A2 | 6/2011 |

OTHER PUBLICATIONS

Written Opinion of the International Searching Authority, issued on Jul. 17, 2014, during the prosecution of International Application No. PCT/US2014/026293.

* cited by examiner

ACOUSTIC ARTIFICIAL LIFT SYSTEM FOR GAS PRODUCTION WELL DELIQUIFICATION

TECHNICAL FIELD

The present invention relates to deliquification of gas production wells, and more particularly, to an acoustic artificial lift system and method for deliquification of gas production wells.

BACKGROUND

In subterranean reservoirs that produce gas, liquids (e.g., water) often are present as well. The liquids can come from condensation of hydrocarbon gas (condensate), from bound or free water naturally occurring in the formation (e.g., interstitial and connate water), or from liquids introduced into the formation (e.g., injected fluids). Regardless of the liquid's origin, it is typically desired to transport the liquid to the surface through the production wells via the produced gas. Initially in production, the reservoir typically has sufficient energy and natural forces to drive the gas and liquids into the production well and up to the surface. However, as the reservoir pressure and the differential pressure between the reservoir and the wellbore intake declines overtime due to production, there becomes insufficient natural energy to lift the fluids. The liquids therefore begin to accumulate in the bottom of the gas production wells, which is often referred to as liquid loading.

As the liquids begin to collect in the gas production wells, density separation by gravitational force naturally occurs separating the fluid into a gas column (substantially free of liquid) in the upper portion of the production well, a mixed liquid and gas column (with the percentage of liquid to gas increasing as the well depth increases) in the middle portion of the production well, and a liquid column (substantially free of gas) in the bottom portion of the production well. The liquid column can rise over time if the velocity of the produced gas decreases, thereby reducing the ability of the produced gas to transport the liquid to the surface. In this case, the liquid becomes too "heavy" for the gas to lift such that the liquid coalesces and drops back down the production casing or tubing. As the liquid column rises to a height in the production well where the hydrostatic pressure equals or exceeds the gas formation face pressure, the liquid detrimentally suppresses the rate at which the well fluid is produced from the formation and eventually obstructs gas production completely. Accordingly, this liquid needs to be artificially reduced or removed to ensure proper flow of natural gas (and liquids) to the surface.

There are several conventional methods for deliquification of a gas well such as by direct pumping (e.g., sucker rod pumps, electrical submersible pumps, progressive cavity pumps). Another common method is to run a reduced diameter (e.g., 0.25 to 1.5 inches) velocity or siphon string into the production well. The velocity or siphon string is used to reduce the production flow area, thereby increasing gas flow velocity through the string and attempting to carry some of the liquids to the surface as well. Another alternative method is the use of plunger lift systems, where small amounts of accumulated fluid is intermittently pushed to the surface by a plunger that is dropped down the production string and rises back to the top of the wellhead as the well shutoff valve is cyclically closed and opened, respectively. Another method is gas lift, in which gas is injected downhole to displace the well fluid in production tubing string such that the hydrostatic pressure is reduced and gas is able to resume flowing. Additional deliquification methods previously implemented include adding wellhead compression and injection of soap sticks or foamers.

Although there are several conventional methods for removing liquids from a well, few, if any, of the current commercially available methods provide sufficient means for removal of liquid from natural gas wells with low bottom-hole pressure. In addition, some of the above described methods may be cost prohibitive in times where the market value of gas is relatively low or for low production gas wells (i.e., marginal or stripper wells).

SUMMARY

An acoustic artificial lift system and method for deliquification of gas production wells is disclosed.

In embodiments, the invention relates to a method for artificial lift deliquification of production wells. The method comprises the steps of: providing a wellbore that receives reservoir fluids from a producing zone of a subterranean reservoir, the reservoir fluids comprising gas and liquid, wherein the liquid comprise hydrocarbon, water and mixtures thereof in a liquid column at the bottom of the wellbore; providing a production tubing or a casing in the wellbore, wherein the production tubing or casing has a plurality of perforations for gas to flow from the reservoir up the production tubing or casing for subsequent recovery; providing a downhole tool comprising an atomizing chamber down a production tubing or a casing in the wellbore for conversion of the liquid into droplets for transport out of the wellbore by the gas flow up the production tubing or casing; wherein the atomizing chamber is in fluid communication with the liquid in the wellbore and wherein the atomizing chamber is located above the liquid column.

In one aspect, the invention relates to an artificial lift system for deliquification of gas production wells having liquid comprising hydrocarbon, water and mixtures thereof in a liquid column at the bottom of the wellbore, the system comprising: a downhole tool comprising an atomizing chamber for conversion of the liquid into droplets for transport out of the wellbore; a conductive cable for connection to the downhole tool; a power supply that for providing power to the downhole tool through the conductive cable; and means for feeding liquid to the atomizing chamber; wherein in operation, the atomizing chamber is located above the liquid column.

In embodiments, the acoustic artificial lift system comprises an acoustic tool, a conductive cable, a winch, and a control panel. The conductive cable is connected at a first end to the acoustic tool and at a second end to the winch. The control panel controls movement of the acoustic tool within a wellbore using the winch such that liquid molecules within the wellbore are vaporized by an acoustic wave generated from the acoustic tool.

In embodiments, the acoustic tool comprises an ultrasonic emitter having one or more piezoelectric elements that generate the acoustic wave, a power unit that controls the electrical energy level applied to the one or more piezoelectric elements, and a location detection device that is used to determine a depth for which the acoustic tool is positioned within the wellbore.

DETAILED DESCRIPTION

Figure 1:
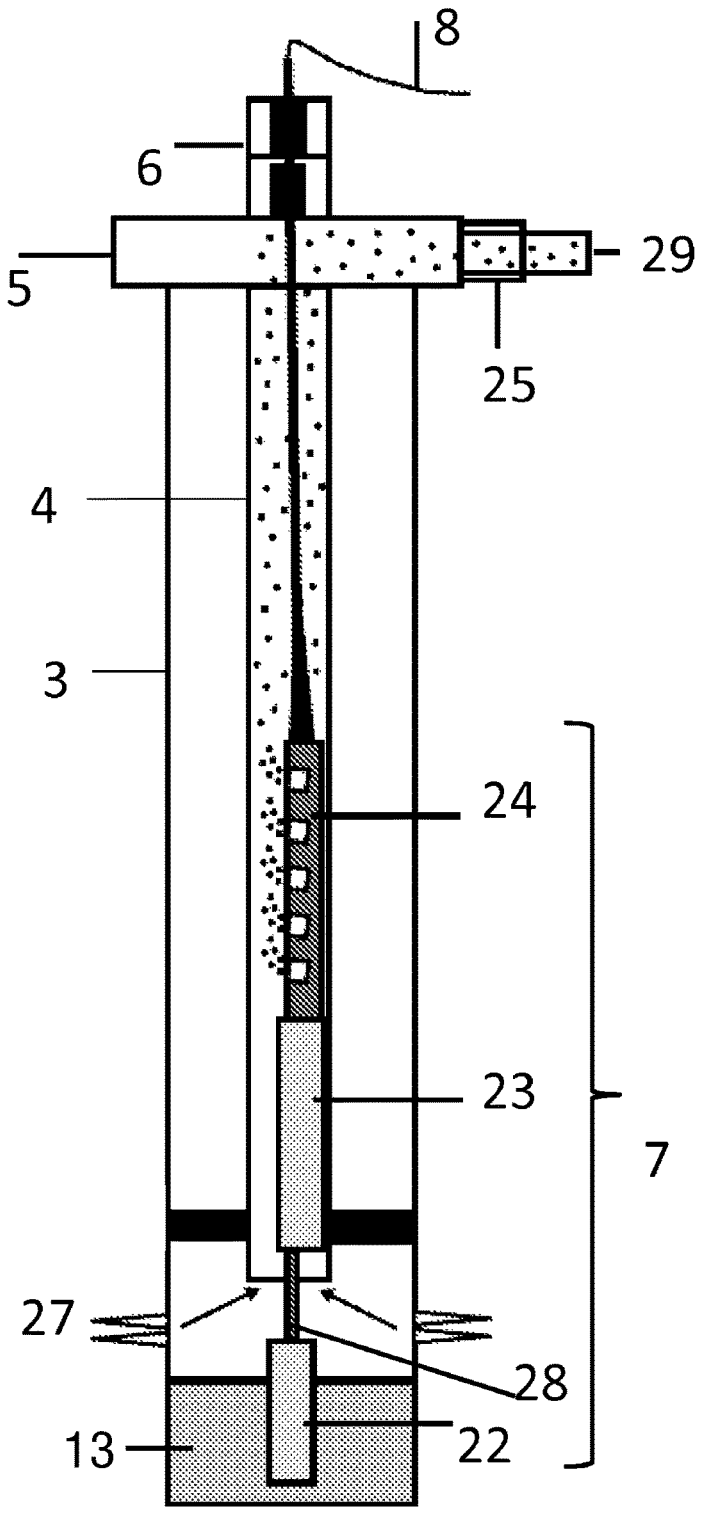
FIG. 1 illustrates an embodiment of the downhole tool of an artificial lift system.

The following terms will be used throughout the specification and will have the following meanings unless otherwise indicated.

Transition Point: In a gaseous well for production or gas well deliquification, the well bore contains an infinite column of gas density and gas phase to liquid phase volume ratios. A transition point refers to a point (depth) in the annulus column where a gas density or gas-liquid phase relationship exists and can be estimated, measured, and or calculated because of the relationship between pressure, temperature, volume, atomic mass and or the molar mass.

Gas liquid ratio refers to the volume of gas compared to the volume of liquid in the well bore annulus, which ratio is usually expressed in the form of a mathematical ratio.

Transition Column refers to one or more transition points in vertical array, inclined array, or horizontal array.

Interval transit time means the time to transmit a signal from a transmitter to the liquid level in a well bore and receive that same signal reflected back to a receiver.

Liquid column interface refers to the uppermost boundary of the liquid phase in the well bore, or the location where liquid surface tension exists; wherein surface tension is a contractive tendency of the surface of a liquid that allows it to resist an external force. At liquid-gas interfaces, surface tension results from the greater attraction of liquid molecules to each other (due to cohesion) than to gas (due to adhesion).

Winch may be used interchangeably with "hoist," for use in conjunction with a cable and pulley system to lift and/or position equipment such as the acoustic tool in the well bore.

Production well refers to hydrocarbon production wells in general, which can be a vertical well, directional well, horizontal well or a multilateral well. Production well can be completed in any manner (e.g., a barefoot completion, an open hole completion, a liner completion, a perforated casing, a cased hole completion, a conventional completion).

Subterranean reservoir refers to any type of subsurface formation in which hydrocarbons are stored, such as limestone, dolomite, oil shale, sandstone, or a combination thereof.

Acoustic wave as used herein refers to a wave generated by a rotating surface or a vibrating surface into a medium, such wave can be sonic or ultrasonic.

Atomizer, which may be used interchangeably with sprayer, mister, or fogger, referring to an apparatus that converts liquid into droplets. In an atomizer, acoustic wave induced or generated by a vibrating surface is employed to break up the liquid medium into droplets. The droplets can be of different sizes, e.g., from a few microns (as mist) to hundreds if not thousands of microns.

Atomize or atomizing, which may be used interchangeably herein with vaporizing, fogging, or spraying, referring to the step of converting liquid into droplets.

Embodiments of the present invention relate to an acoustic artificial lift system and method for deliquification of gas production wells, thereby supporting natural gas production. In the system, an tool comprising at least an atomizer is systematically lowered into the production well to atomize liquids such that they can be transported to the surface by the produced gas (e.g., removed by the flowing gas). The removal of liquid is via an acoustic droplet vaporization process.

The acoustic artificial lift system comprises a downhole tool and a surface system. The downhole tool comprises an atomizing chamber (e.g., a sprayer assembly), optionally an electronic assembly, optionally a pump or other means such as a capillary tube to feed liquid into the atomizer. In one embodiment, the surface system comprises an electrical cable for connecting the downhole tool to the surface, a power supply for the downhole tool, a control panel and data acquisition instrumentation (DAI) for use in conjunction with location detection device. Installation of the downhole tool can be made by suspending the tool by a power conductive cable, a winch, lubricator and other tools known in the art. Once the downhole system is installed, the cable can be hung in place and sealed, and the winch can be removed. The winch system can be brought back to the site to retrieve the downhole tool for servicing if needed.

In one embodiment, the atomizing chamber comprises a plurality of atomizers (e.g., mister, atomizer, fogger), with each comprising an acoustic transducer (e.g., a sonic transducer or an ultrasonic transducer) and an acoustic horn located therein. Atomizer systems and ultrasonic atomizers are disclosed in U.S. Pat. Nos. 3,860,173, 4,742,810, 4,153,201, 4,337,896, 5,219,120, and US Patent Publication No. 20140011318, the relevant disclosures are incorporated herein by reference. In another embodiment, the atomizing chamber comprises a plurality of nozzles, e.g., impeller nozzles as disclosed in U.S. Pat. No. 4,854,822, relevant disclosure is incorporated herein by reference.

In one embodiment with the use of ultrasonic atomizers, the atomizers are disposed on the atomizer housing. In another embodiment, they are integrated into the atomizer housing. In a third embodiment, the atomizers are arranged in one or more vertical arrays on one side of the atomizer housing. In one embodiment, some of the atomizers are disposed on top of the downhole tool, pointing upward in the wellbore.

The acoustic energy generated by the transducers vibrates the liquid molecules at a sufficient frequency so that the surface tension of the liquid droplets shears and collapses into smaller droplets, for a very low velocity spray of liquid droplets. Eventually, the vibration causes the liquid (e.g., water) to "vaporize" (e.g., atomize) such that it can then be transported to the surface by the natural gas velocity in the well. Once on the surface, the liquid can be separated from the natural gas according to processes well known in the art.

The liquid droplets have an average diameter of less than 10,000 μm in one embodiment; less than 1,000 μm in a second embodiment; less than 100 μm in a third embodiment; less than 10 μm in a fourth embodiment, and in the range of 20-100 μm in a fifth embodiment. In one embodiment, the sufficient frequency is greater than or equal to any of 10 kHz, 100 kHz, 500 kHz, 1 MHz, or 2 MHz. In one embodiment, the frequency is in the range of 50-100 Hz. In another embodiment, the frequency is in the range of 100,000 Hz to 200,000 Hz. It is expected that the droplets in the 10-100 μm range is easier to be transported in gas flow than the larger droplets.

The plurality of atomizers provide a sufficient rate of the conversion and removal of liquid, e.g., at least 5 barrels per day (BPD) in one embodiment, at least 10 BPD in a second embodiment, at least 30 BPD in a third embodiment, and at least 100 BPD in a forth embodiment. The liquid is atomized into droplets at a sufficiently low velocity, exiting a plurality of exits located along the atomizing chamber, and carried upward with the gas flow exiting the chamber for subsequent gas/liquid separation. The gas flow is at least 10 scf/min. in one embodiment; at least 30 scf/min. in a second embodiment; and at least 50 scf/min. in a third embodiment. The low velocity spray of the droplets allows the entry into the gas flow without impinging on the internal diameter of the production tubing. If the spray hits the wall, the droplets rejoin together and fall down the well.

In one embodiment, the transducer is an ultrasonic transducer (or ultrasonic vibrator) with a vibrating or a rotating surface to convert liquid into droplets. In another embodiment, the transducer is a piezoelectric ultrasonic transducer. The ultrasonic transducer is attached to the acoustic horn (e.g., a "stepped horn") so as to emit ultrasonic vibration by an electric power source which is tuned to a constant maximum output. The atomizers are in fluid communication with liquid at the bottom of the production well flows via means known in the art, e.g., a pump or a capillary tubing. In one embodiment, a pump supplies liquid to the atomizer, whereupon the ultrasonic vibrator causes the liquid to disintegrate into droplets and subsequently carried upward by the gas flow (from the reservoir into the casing/tubing through perforations).

During operation, the atomizing chamber is above the liquid interface, as liquids would absorb the droplets thus rendering the tool ineffective. In another embodiment, the acoustic tool is only partially submerged in the accumulated liquid, with part of the downhole tool being in the liquid to help cooling the tool from heat generation, but the atomizing chamber being above the liquid interface, as liquids would absorb the droplets generated by the acoustic tool thus rendering the tool ineffective. As the tool is partially submerged, liquid is pumped from the liquid column up to the atomizing chamber where the vaporization or atomizing phenomena occurs. In one embodiment, liquid is drawn by a tube extension with the atomizer above submergence level.

In one embodiment, a pump is located at the bottom of the well submerged in the liquid, or at least partially submerged in the liquid. In another embodiment, the pump is located below the perforations in the casing. The pump is employed to feed liquid to the atomizer for the atomizer to be in fluid communication with the liquid column, either connected directly to the atomizer, or indirectly via the electronic assembly. In yet another embodiment, the pump assembly is connected to the atomizer indirectly by a tube (or pipe), which allows a distance between a submerged or partially submerged pump and the atomizer which is to be kept above the liquid level. In one embodiment, the tube connecting the pump with the atomizer also houses electrical cables or conductors providing electrical connection to the pump assembly. The conductors can also be used to send/receive signals from the sensors in the pump assembly to ensure that the liquid level is sufficient to keep the pump submerged, e.g., turning off the motor to the pump if the liquid is not present or at too low a level, and turning on the pump if liquid is returned to a sufficient level.

In one embodiment, the downhole tool is suspended from the wireline cable with the atomizing chamber located at the top of the tool, and positioned in a fixed location in the wellbore. In one embodiment, the downhole tool further comprises an electronic assembly which comprises a liquid location detection device, allowing the atomizing chamber to be moved within the wellbore depending on the transition point in the mixed liquid and gas column. The location detection device is for measurements, e.g., detecting the liquid level in the well, or providing distance measurements between the atomizer and a transition point in a mixed liquid and gas column in the wellbore, etc. As the level of the liquid in a mixed liquid and gas column in the well bore decreases, the atomizer tool can be repositioned to be proximate (i.e., at or just above) the liquid interface of liquid column. In one embodiment, the location detection device transmits a signal and capture the interval transit time for the signal to be echoed off the surface of liquid column or the transition point of a particular fluid density. The interval transit time can then be used to compute the distance between the atomizing chamber (e.g., the acoustic tool) and the surface of liquid column or the transition point of a particular fluid density within the production well. Alternatively, the location detection device can transmit the interval transit time through a conductive cable to a control panel for computing the distance between the downhole tool and the liquid column, or the transition point of a particular fluid density within the production well. In embodiments, the transition point has a gas to liquid ratio of greater than or equal to 1000. In other embodiments, the transition point has a gas to liquid ratio of greater than or equal to 5000. In a third embodiment, the transition point has a gas to liquid ratio of less than 20,000.

In one embodiment, the downhole tool further comprises a driver for the ultrasonic transducers, cables for communicating with the surface system, voltage converting power unit (from the input voltage to various voltage levels required for the various circuits), and motor driver circuits. The power unit can include a power receiver, power converter, power attenuator, and any other power equipment needed to apply a sufficient amount of electrical current to transducers for the frequency spectrum of kilo hertz (kHz) to megahertz (MHz).

In one embodiment, the surface system comprises a control panel and data acquisition instrumentation (DAI) for use in conjunction with location detection device. The DAI which transmits and receives a signal from the liquid level detection device that can be used to determine a distance from the surface of liquid column within the production well, or a distance from a transition point to a predefined ratio of liquid to gas within the production well (i.e., a particular fluid density in mixed liquid and gas column). The control panel recalculates and repositions the downhole tool, e.g., calculating the distance between atomizer and the liquid interface of liquid and gas column and automatically adjusting by raising or lowering the tool. It should be noted that the control panel and DAI can also be part of the electronics section in the downhole tool.

The control panel is an intelligent interface, often integrated with supervisory control and data acquisition (SCADA) ability that processes the signals from components such as the acoustic tool, the winch, the power unit, etc. The control panel can also activate (i.e., turn on), deactivate (i.e., turn off), and control the intensity of the acoustic waves generated by the acoustic tool(s). Variable speed drive (VSD), also called adjustable speed drive (ASD) and variable frequency drive (VFD), can be utilized by a control panel to control the components of acoustic artificial lift system. Control panel is powered via a power source, which can comprise any means to supply power to any of the acoustic tool, winch, control panel and other well field equipment (e.g., sensors, data storage devices, communication networks).

Each production well can employ a single downhole tool, or multiple tools to provide redundancy in the event that an atomizing chamber or electronic instrument fails and can accelerate deliquification of the production well. The tools can operate at different frequencies, generating wave energy adapted for the separate tasks, e.g., atomizing the liquid and sensing the liquid level. In one embodiment of multiple acoustic tools, each acoustic tool can generate the same or various levels of acoustic energy, e.g., one or more acoustic tools with an atomizer for vaporizing the liquid in the wellbore, and one acoustic tool with a location detection device for the distance measurements. The number of tools can be dependent on well depth to reduce the likelihood of the liquid coalescing and dropping back down the production casing.

The artificial lift system is relatively straightforward to deploy, requires a relatively small surface footprint, does not inflict damage on the wellbore, production equipment or reservoir formation, is environmentally friendly, and may reduce operational costs related to rig expense and safety. In one embodiment, because the artificial lift system is not predominantly a mechanical system, it can enhance the range of natural gas production and extend the life of a producing well.

Reference will be made to the figures to illustrate different embodiments of the invention.

FIG. 1 is a schematic diagram illustrating an embodiment of an artificial lift system with a downhole tool 7. As shown, outer production casing 3 is cemented or set to the well depth (e.g., plugged back total depth, completed depth, or total depth). Production string or tubing 4 is inserted into the well to assist with producing fluids from the hydrocarbon bearing zone of a subterranean reservoir. Production casing 3 and production string 4 are connected to or hung from wellhead 5, which is positioned on the surface (i.e., ground surface or platform surface in the event of an offshore production well). Wellhead 5 additionally provides access and control to production casing 3 and production string 4. In one embodiment (not shown), wellhead 5 includes what is commonly known in the petroleum industry as a Christmas tree (i.e., an assembly of valves, chokes, spools, fittings, and gauges used to direct and control produced fluids, as part of the surface system), which can be of any size or configuration (e.g., low-pressure or high-pressure, single-completion or multiple-completion). Stuffing box or lubricator 6 is positioned on top of, and connected to, wellhead 5. Lubricator 6 is used to provide lubrication for any cables (e.g., wireline or electric line) run in a completed well. Lubricator 6 also functions as a cable retainer, and provides a seal to prevent tubing leaks or "blowouts" of produced fluids from hydrocarbon bearing zone of the subterranean reservoir. Other well intervention devices can be used in addition to or instead of lubricator 6, such as coil tubing injector heads or blow out preventer stacks.

The downhole tool 7 is generally cylindrical in shape. However, the tool 7 can be any shape or size as long it can fit and move (vertically upward or downward) within a wellbore. The tool 7 is suspended by a power conductive cable 8 via pulley and winch (not shown, that can be supported by an adjustable crane arm, stationary support system, or by any other means). Lubricator 6 lubricates conductive cable 8 as it is positioned within production tubing 4. Lubricator 6 also provides a seal with power conductive cable 8 to prevent escape of produced fluids from hydrocarbon bearing zone 2 of subterranean reservoir 1. A power unit (not shown) controls and modulates the electrical energy level applied.

The tool 7 comprises an atomizer 24 (located above the liquid level), electronics 23, pump 22, and tubing 28 for connecting the pump with the atomizer/electronics. The electronics section 23 includes a location detection device to determine the depth for which components of the tool 7 can be positioned within production tubing 4. With the electronics 23, the tool can transmit the interval transit time through conductive cable 8 to a controller / control panel (not shown, as in a surface system) for computing the distance between downhole tool 7 and the liquid column, or the transition point of a particular fluid density within the production well. In either case, a control panel receives either the computed distance or interval transit time from downhole tool 7, and determines the proper depth for which downhole tool 7 should be positioned within production tubing 4. In one embodiment, the controller is located in the downhole tool as part of the electronics 23. Within production tubing 4, the atomizer 24 atomizes the liquid composition so that the liquid is removed from liquid column 13 as droplets by the gas flow upward. Gas is removed from the reservoir (as shown by arrows) through perforations 27. The gas/liquid mixture 25 is subsequently routed to a separator 29 (not shown).

Figure 2:
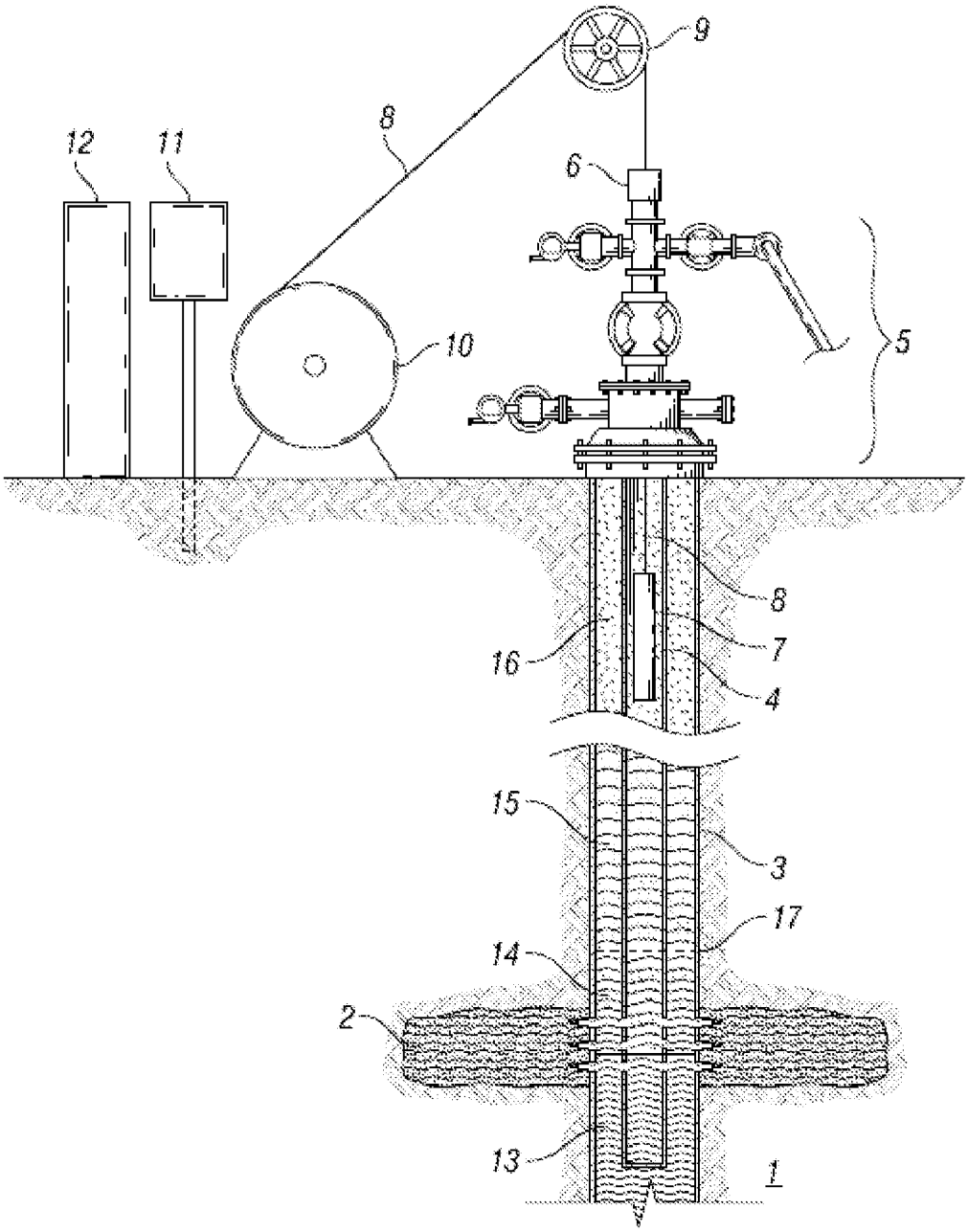
FIGS. 2-5 are schematics of another embodiment of an artificial lift system, illustrating deliquification of a gas production well having production tubing.
Figure 3:
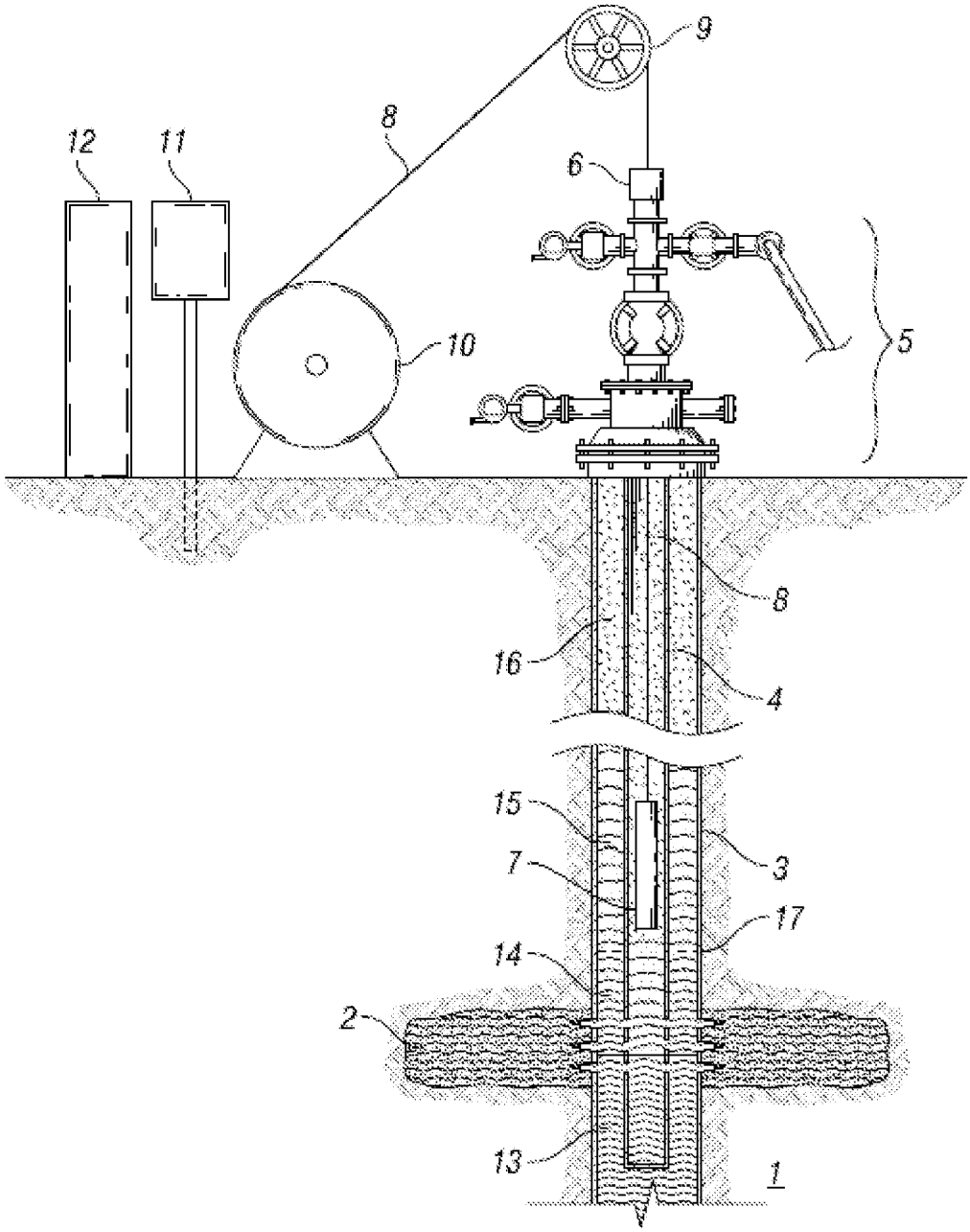
Figure 4:
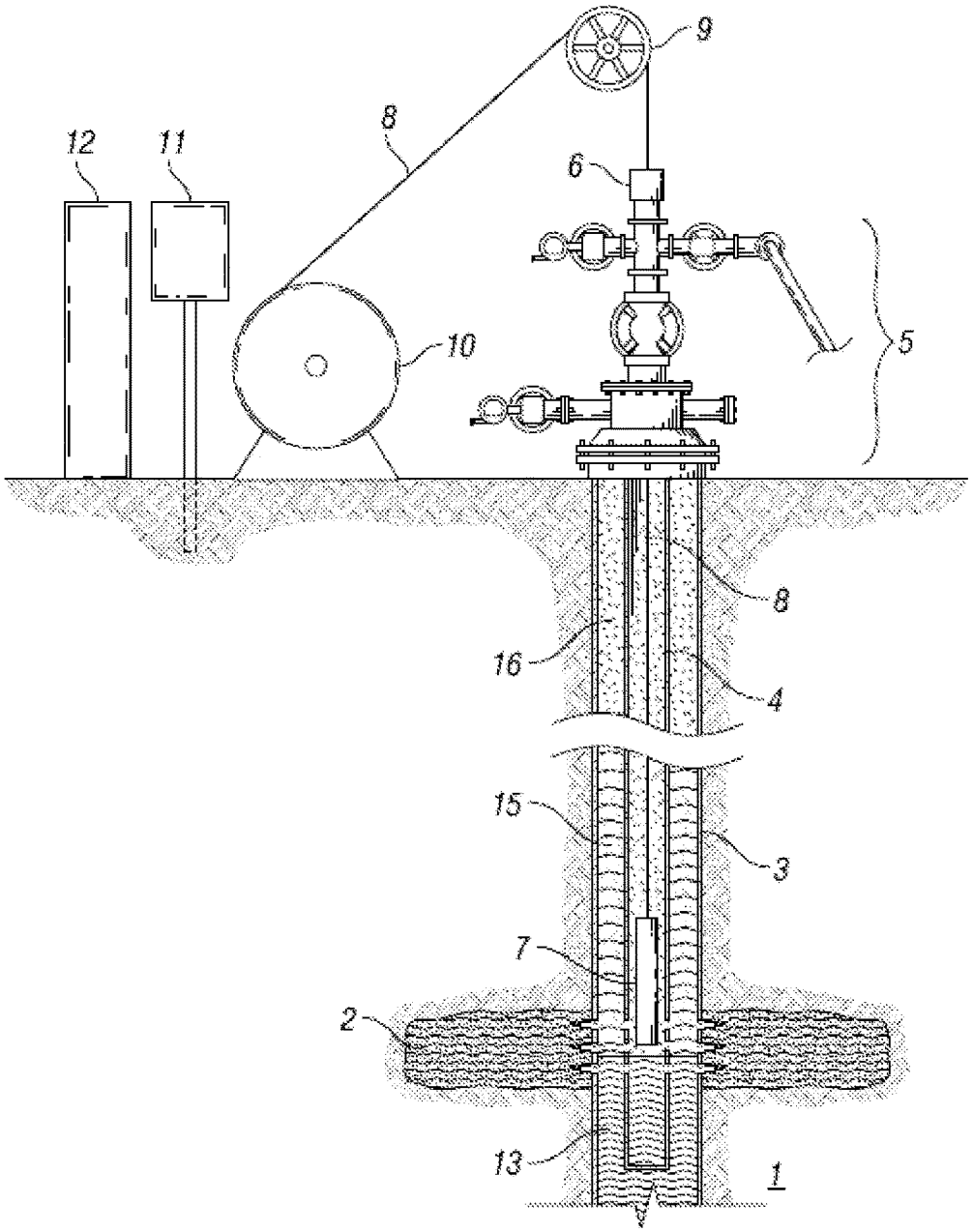
Figure 5:
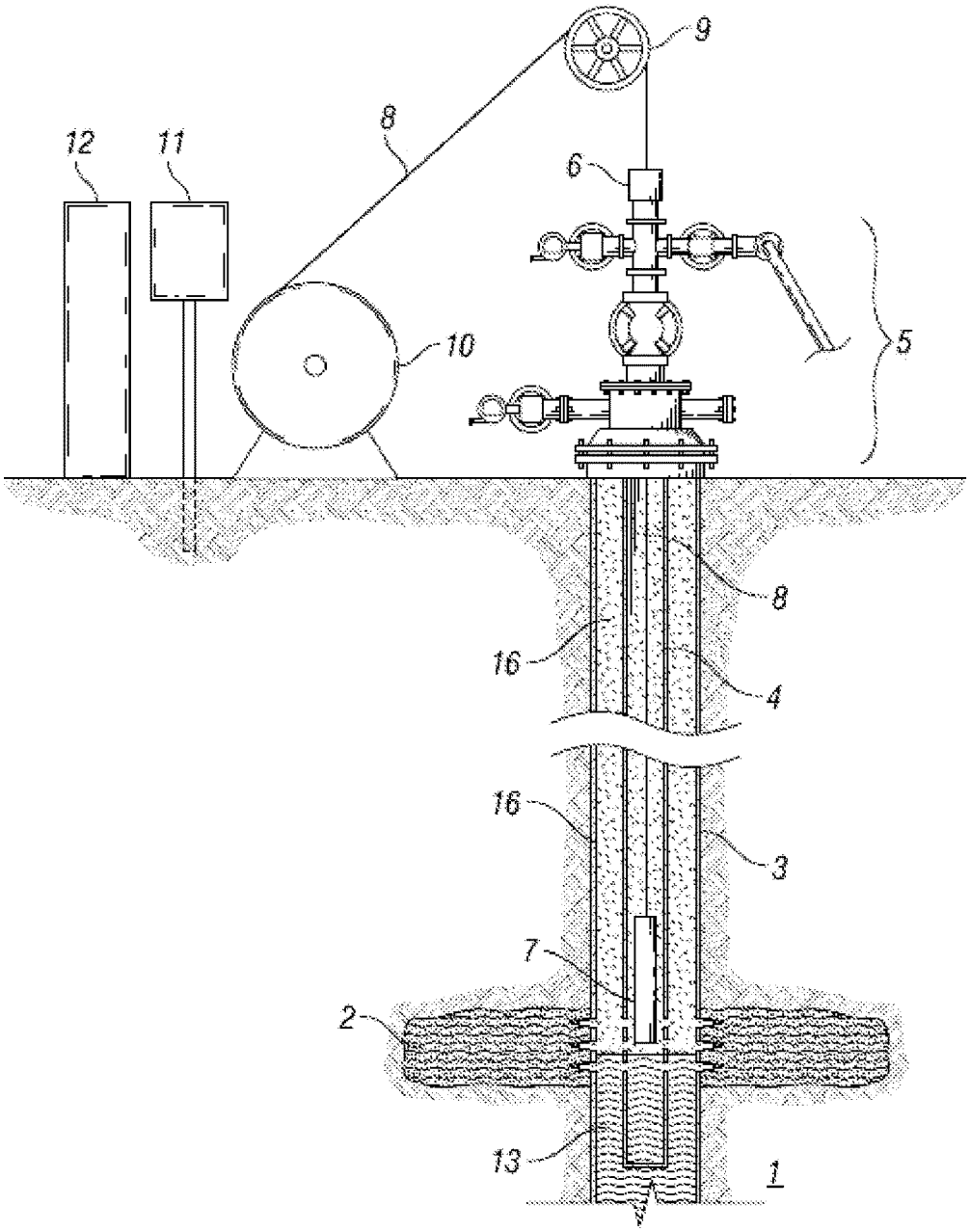
Figure 6:
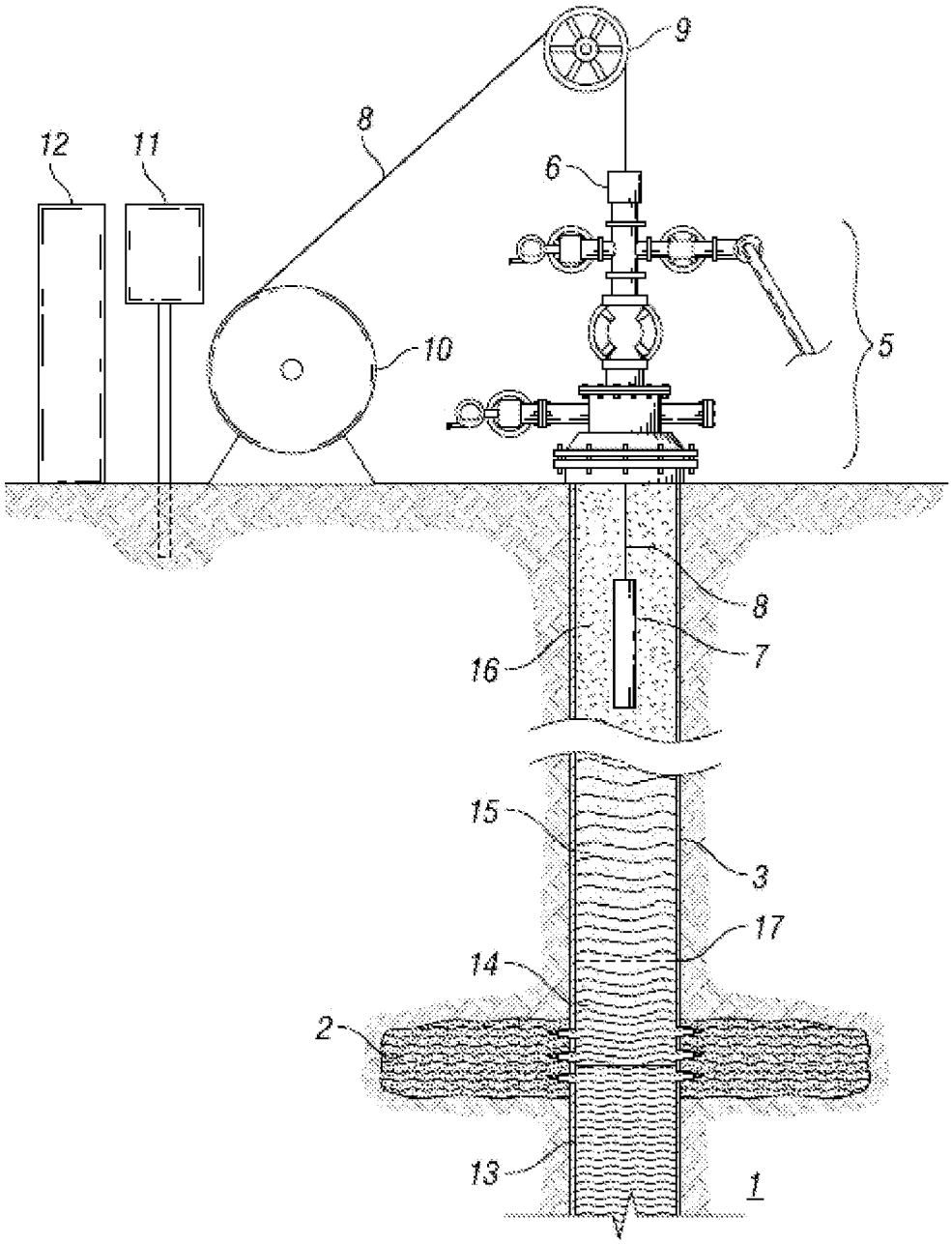
FIGS. 6-9 are schematics of yet another embodiment of an artificial lift system, illustrating deliquification of a gas production well without production tubing.
Figure 7:
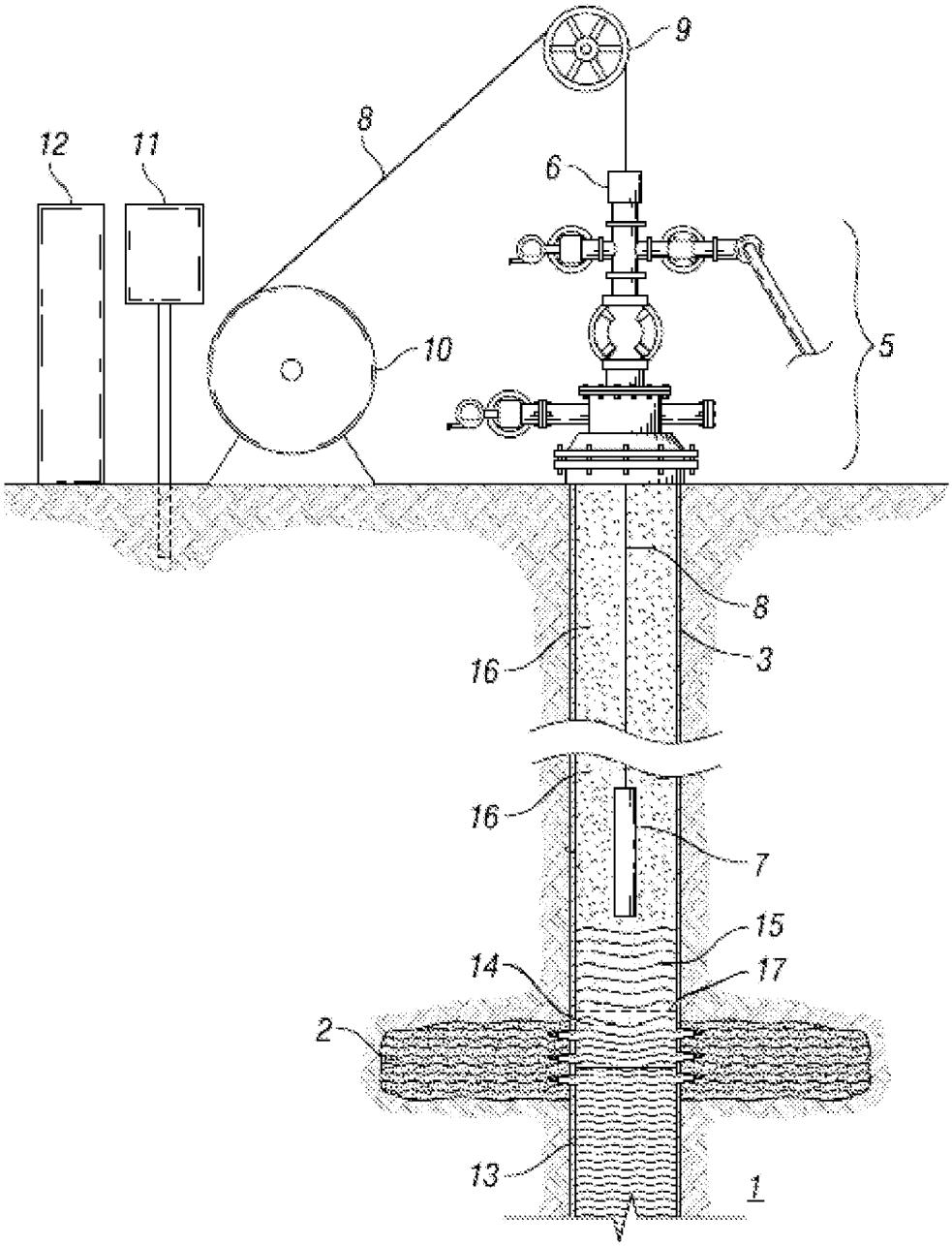
Figure 8:
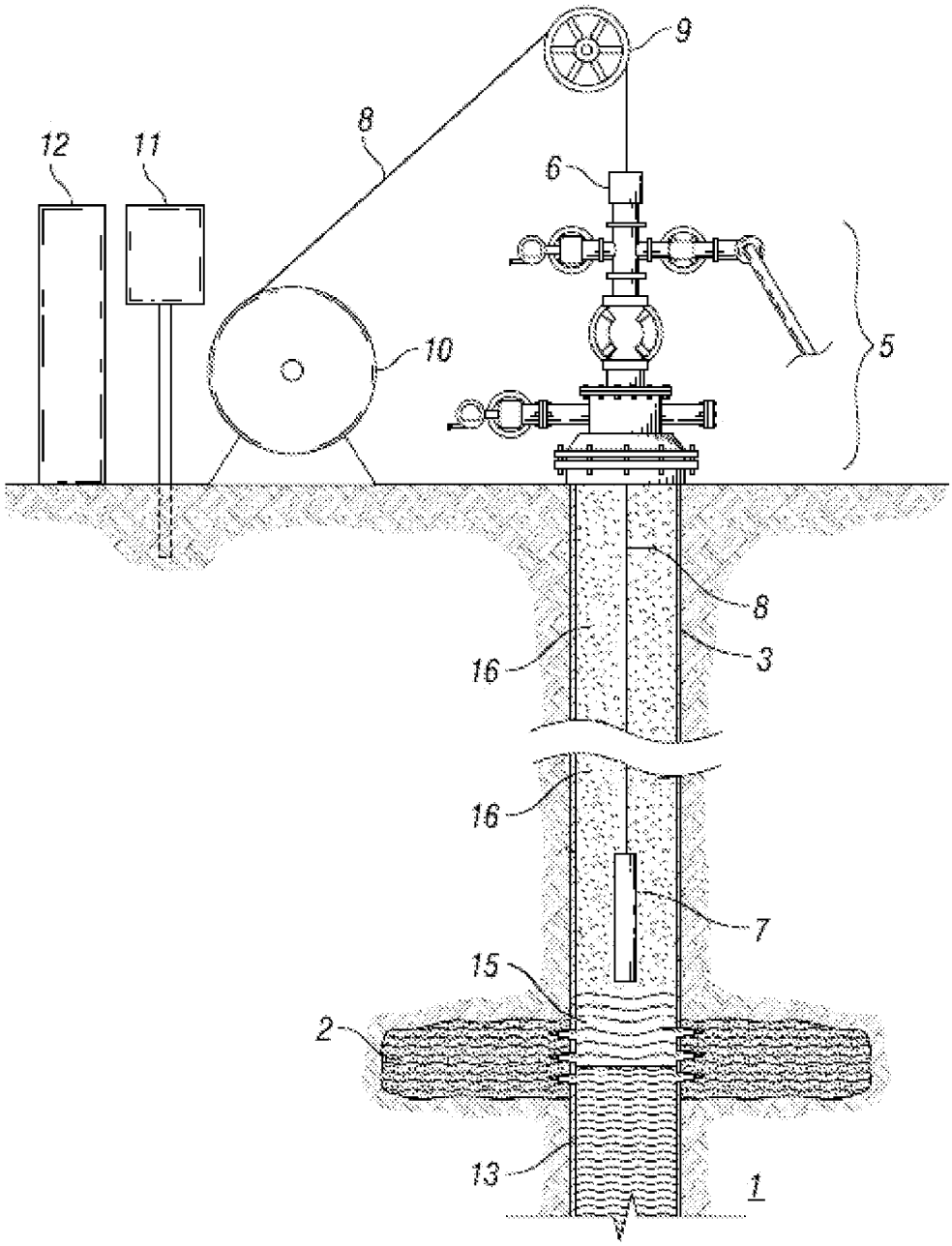

FIGS. 2-5 illustrate the deliquification process of a gas production well having production tubing 4. Means for supplying liquid to the atomizing chamber of the tool is not shown. Here, production occurs through production tubing 4 and the gas composition increases in the production casing 3 by the removal of liquid via production tubing 4. If the production well is "dead" (i.e., no gas flow exists due to hydrostatic liquid column pressure), then the production well typically needs to be swabbed via production tubing 4. After swabbing, liquids in the production well naturally separate into liquid column 13, a transition column of mixed liquid and gas 14, 15, and gas column 16. As downhole tool 7 is lowered (FIG. 3), downhole tool 7 enters into mixed liquid and gas column 15 (i.e., gas dominant portion of mixed liquid and gas column). Within production tubing 4, the atomizer of the tool atomizes the liquid composition so that the liquid is removed by the gas flow. Accordingly, mixed gas and liquid column 15 transitions to gas column 16 within production tubing 4 as the tool 7 is lowered. This reduction in liquid head pressure results in gas expansion in mixed liquid and gas column 14 while reducing the liquid composition. The tool is systematically lowered into production well (according to control panel 11) and continues to atomize the liquid with the gas flow carrying the atomized liquid up the tubing to the surface. The process continues until the tool is lowered to point where the inflow rate from hydrocarbon bearing zone 2 of subterranean reservoir 1 is substantially equivalent to the production rate through production tubing 4 (FIG. 4). Additionally, while the tool 7 is operated in production tubing 4, gas column 16 is produced up production casing 3 (FIG. 5). Gas column 16 will continue to expand as the hydrostatic pressure from the liquid components in production casing 3 is reduced.

In operation, the tool 7 is lowered into production string 4 to reduce, remove, or prevent the accumulation of liquid at the bottom of the production well, thereby allowing for unhindered flow of natural gas (and liquids) to the surface. If liquid loading has occurred, the liquids naturally separate into liquid column 13, a transition column of mixed liquid and gas, and gas column 16. As illustrated, the percentage of liquid to gas within the transition column increases as the well depth increases. In particular, dashed line 17 represents a transition point such that below dashed line 17 the density of fluid is heavier (mixed liquid and gas column 14) and above dashed line 17 the density of fluid is lighter (mixed gas and liquid column 15).

FIG. 2 is a schematic of an embodiment of the artificial lift system for deliquification of gas production wells. As illustrated, a production well is drilled and completed in subterranean reservoir 1. Subterranean reservoir 1 includes a plurality of rock layers including hydrocarbon bearing strata or zone 2. The production well extends into hydrocarbon bearing zone 2 of subterranean reservoir 1 such that the production well is in fluid communication with hydrocarbon bearing zone 2 and can receive fluids (e.g., gas, oil, water) therefrom. While not shown, additional injection wells and/or production wells can also extend into hydrocarbon bearing zone 2 of subterranean reservoir 1.

In FIG. 3, the production well includes an outer production casing 3. As downhole tool 7 is lowered into production tubing 4, downhole tool 7 is activated for the atomizer to generate liquid droplets. As the level of the liquid in mixed liquid and gas column 14, 15 decreases, control panel 11 recalculates and repositions the downhole tool 7. In one embodiment, control panel 11 calculates the distance between downhole tool 7 and the liquid interface of liquid and gas column 14 and automatically adjusts (i.e., raises or lowers) downhole tool 7 to be positioned proximate (i.e., at or just above) the liquid interface of liquid and gas column 14 (i.e., dashed line 17). In another embodiment, control panel 11 calculates the distance between downhole tool 7 and the liquid interface of liquid column 13 and automatically adjusts (i.e., raises or lowers) downhole tool 7 to be positioned proximate (i.e., at or just above) the liquid interface of liquid column 13.

Figure 9:
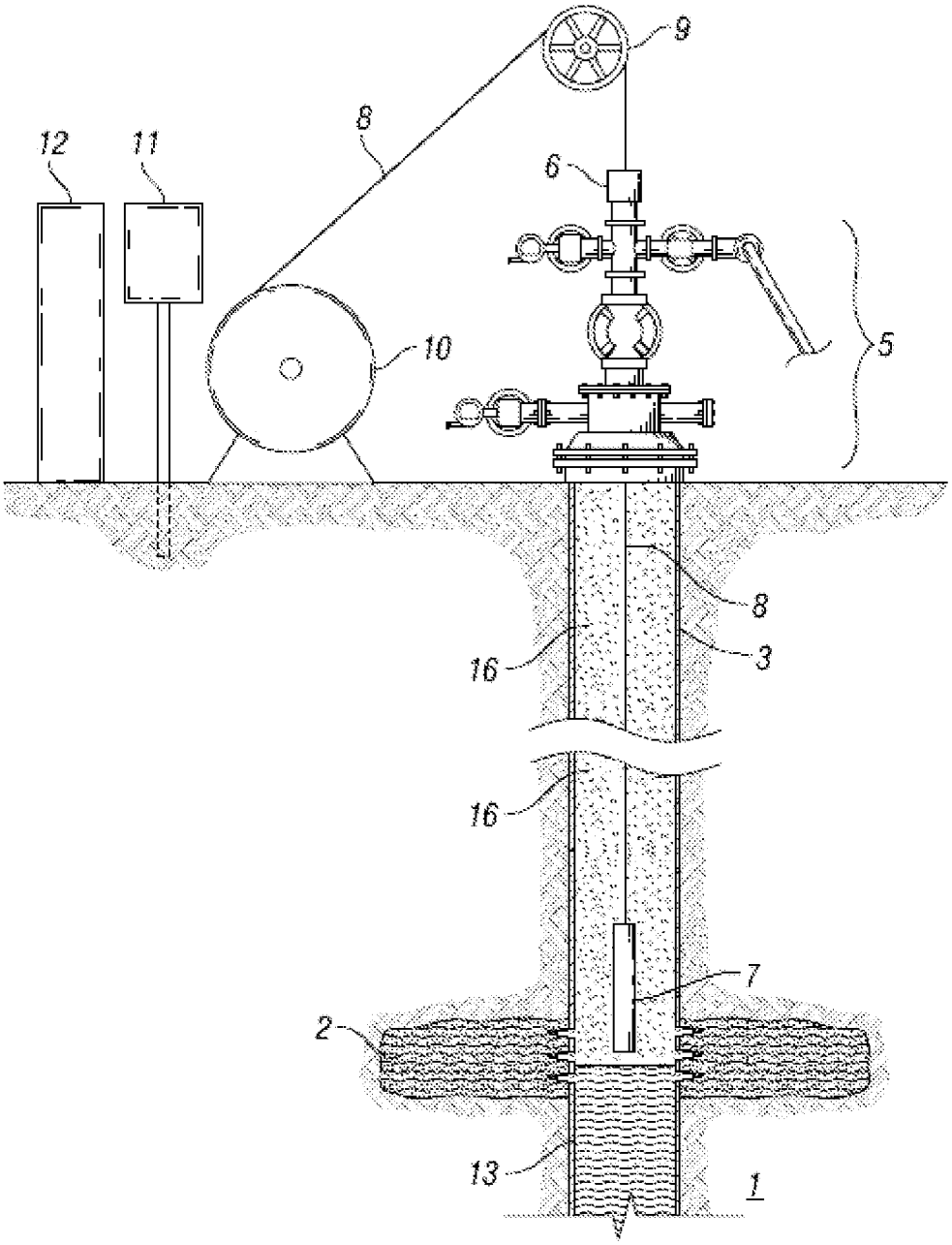

FIGS. 6-9 illustrate deliquification of a gas production well having a cased hole completion (i.e., without production tubing). Means for supplying liquid to the atomizing chamber of the tool is not shown. As downhole tool 7 is lowered into production casing 3 (FIG. 6), downhole tool 7 is activated for the atomizer to generate liquid droplets. Similar to FIGS. 2-5, as the level of the liquid in mixed liquid and gas column 14, 15 decreases, control panel 11 recalculates and repositions downhole tool 7. As shown, gas and liquid column 15 becomes diminished and transitions into gas column 16. Furthermore, liquid and gas column 14 becomes diminished and transitions from a liquid dominate composition to a gas dominant composition (i.e., transitions into gas and liquid column 15). The decreased head pressure eventually results in removal of both gas and liquid column 15 and liquid and gas column 14 (FIG. 9). Reservoir pressure and the relative water and gas permeabilities in hydrocarbon bearing zone 2 of subterranean reservoir 1 result in increased fluid flow into production casing 3 via the perforations until an equilibrium or stable production level is achieved. At this point, the inflow of liquids into production casing 3 is countered by the removal of liquids by the downhole tool 7 and carried up production casing 3 by the gas flow.

As shown in FIGS. 2-9, downhole tool 7 has little impact on liquid column 13. However, if the gas relative permeability increases sufficiently in hydrocarbon bearing zone 2 of subterranean reservoir 1, then it may become possible to lower downhole tool 7 until liquid column is reduced and downhole tool 7 can be placed at the formation face or adjacent the production well perforations.

Figure 10:
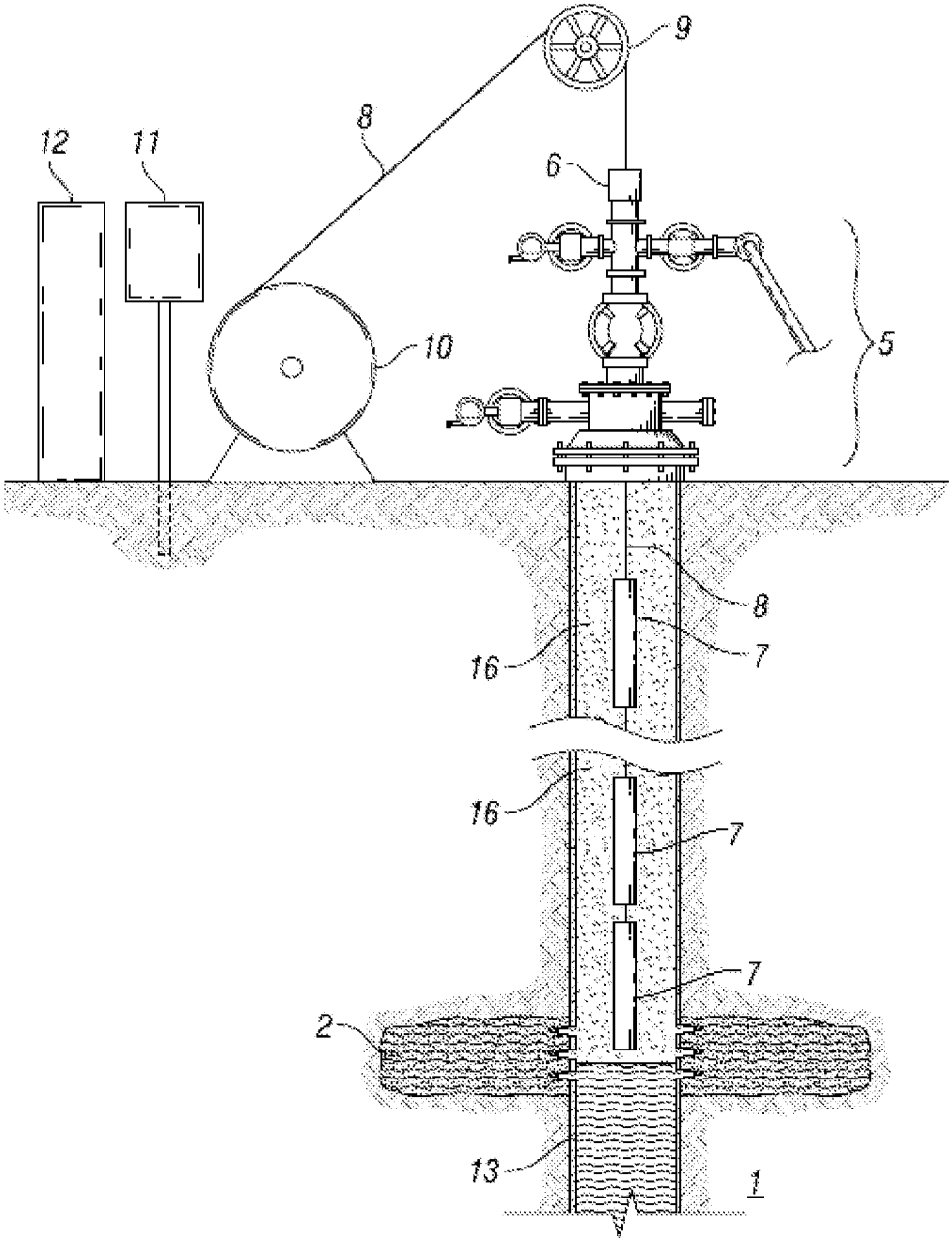
FIG. 10 is a schematic of an artificial lift system having multiple acoustic emitters used for deliquification of gas production wells.

FIG. 10 is a schematic of an acoustic artificial lift system having multiple tools 7 positioned within production casing 3. Means for supplying liquid to the atomizing chamber(s) of the tools is not shown. While FIG. 10 shows a cased hole completion, one skilled in the art will recognize multiple tools 7 can be utilized in other completion types (e.g., completions including production tubing).

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%.

While in the foregoing specification this invention has been described in relation to certain preferred embodiments thereof, and many details have been set forth for the purpose of illustration, it will be apparent to those skilled in the art that the invention is susceptible to alteration and that certain other details described herein can vary considerably without departing from the basic principles of the invention. For example, while embodiments of the present disclosure are described with reference to operational illustrations of methods and systems, the functions/acts described in the figures may occur out of the order (i.e., two acts shown in succession may in fact be executed substantially concurrently or executed in the reverse order). In addition, the above-described system and method can be combined with other artificial lift techniques (e.g., velocity or siphon strings, gas lift, wellhead compression, injection of soap sticks or foamers).

What is claimed is:

1. A method for artificial lift deliquification of production wells, the method comprising:

(a) providing a wellbore that receives reservoir fluids from a producing zone of a subterranean reservoir, the reservoir fluids comprising gas and liquid, wherein the liquid comprise hydrocarbon, water and mixtures thereof in a liquid column at the bottom of the wellbore;

(b) providing a production tubing or a casing in the wellbore, wherein the production tubing or casing has a plurality of perforations for gas to flow from the reservoir up the production tubing or casing for subsequent recovery;

(c) providing a downhole tool down the production tubing or casing in the wellbore, the downhole tool comprising:

(i) an atomizing chamber for conversion of the liquid in the atomizing chamber into droplets, wherein the atomizing chamber is in fluid communication with the liquid in the wellbore during operation to provide the liquid to the atomizing chamber, and wherein the atomizing chamber is located above the liquid column during operation to facilitate exit of the droplets from the atomizing chamber for the transport of the droplets via the gas flow up the production tubing or casing, and wherein the atomizing chamber comprises a plurality of atomizers, and wherein each atomizer comprises a piezoelectric acoustic transducer, and wherein each piezoelectric acoustic transducer comprises one or more piezoelectric crystals for driving a rotating or vibrating surface to generate an acoustic wave that converts the liquid in the atomizing chamber into the droplets;

(d) generating the acoustic wave with the atomizing chamber, wherein the acoustic wave generated by the atomizing chamber has a frequency in an ultrasonic spectrum;

(e) vaporizing the liquid within the atomizing chamber through vibration of the liquid by the acoustic wave emitted within the atomizing chamber, wherein vaporizing the liquid converts that liquid into the droplets; and (f) transporting the droplets that exit the atomizing chamber to a well surface by the gas flow up the production tubing or casing.

2. The method of claim 1, further comprising providing a pump to feed liquid in the liquid column to the atomizing chamber for the atomizing chamber to be in fluid communication with the liquid in the wellbore.

3. The method of claim 1, further comprising providing a capillary tube for feeding liquid in the liquid column to the atomizing chamber for the atomizing chamber to be in fluid communication with the liquid in the wellbore.

4. The method of claim 1, wherein the downhole tool further comprises at least a sensor for detection of liquid level in the wellbore.

5. The method of claim 4, further comprising computing a distance between the downhole tool and a transition point in a mixed liquid and gas column in the wellbore, and positioning the downhole tool vertically in the wellbore relative to the transition point.

6. The method of claim 5, wherein the transition point has a gas to liquid ratio of greater than or equal to 1000.

7. The method of claim 1, wherein the plurality of atomizers are disposed in one or more arrays along a vertical side of the downhole tool.

8. The method of claim 1, wherein one or more atomizers are disposed on top of the downhole tool and pointing upward in the wellbore.

9. The method of claim 1, wherein the droplets have an average diameter of less than 10,000 μm.

10. The method of claim 9, wherein the droplets have an average diameter of less than 1,000 μm.

11. The method of claim 10, wherein the droplets have an average diameter of less than 100 μm.

12. The method of claim 11, wherein the droplets have an average diameter of less than 10 μm.

13. The method of claim 1, wherein each atomizer comprises the piezoelectric acoustic transducer and an acoustic horn.

14. The method of claim 1, wherein a frequency of the acoustic waves is in a range of 10 kHz-2 MHz.

15. An artificial lift system for deliquification of gas production wells including a wellbore receiving reservoir fluids from a producing zone of a subterranean reservoir, the reservoir fluids comprising gas and liquid, wherein the liquid comprise hydrocarbon, water and mixtures thereof in a liquid column at the bottom of the wellbore, and wherein the wellbore comprises a production tubing or a casing in the wellbore with a plurality of perforations for gas to flow from the reservoir up the production tubing or casing for subsequent recovery, the system comprising:

(a) a downhole tool for placement down the production tubing or casing in the wellbore, the downhole tool comprising:

(i) an atomizing chamber for conversion of the liquid in the atomizing chamber into droplets, wherein the atomizing chamber is in fluid communication with the liquid in the wellbore during operation to provide the liquid to the atomizing chamber, and wherein the atomizing chamber is located above the liquid column during operation to facilitate exit of the droplets from the atomizing chamber for the transport of the droplets via the gas flow up the production tubing or casing, and wherein the atomizing chamber comprises a plurality of atomizers, and wherein each atomizer comprises a piezoelectric acoustic transducer, and wherein each piezoelectric acoustic transducer comprises one or more piezoelectric crystals for driving a rotating or vibrating surface to generate an acoustic wave that converts the liquid in the atomizing chamber into the droplets;

(b) a conductive cable for connection to the downhole tool;

(c) a power supply that for providing power to the downhole tool through the conductive cable; and (d) a pump or a capillary tube for feeding the liquid to the atomizing chamber;

wherein the acoustic wave is generated with the atomizing chamber, and wherein the acoustic wave generated by the atomizing chamber has a frequency in an ultrasonic spectrum;

wherein the liquid is vaporized within the atomizing chamber through vibration of the liquid by the acoustic wave emitted within the atomizing chamber, wherein vaporizing the liquid converts that liquid into the droplets;

wherein the droplets that exit the atomizing chamber are transported to a well surface by the gas flow up the production tubing or casing.

16. The artificial lift system of claim 15, further comprising at least a location detection device for detection of liquid level in the wellbore.

17. The artificial lift system of claim 15, further comprising a control panel and data acquisition instrumentation (DAI) for use in conjunction with a location detection device.

18. The artificial lift system of claim 15, wherein the plurality of atomizers are disposed in one or more arrays along a vertical side of the downhole tool.

19. The artificial lift system of claim 15, wherein one or more atomizers are disposed on top of the downhole tool and pointing upward in the wellbore.

20. The artificial lift system of claim 15, wherein each atomizer comprises the piezoelectric acoustic transducer and an acoustic horn.

21. The artificial lift system of claim 15, wherein the droplets have an average diameter of less than 10,000 μm.

22. The artificial lift system of claim 21, wherein the droplets have an average diameter of less than 1,000 μm.

23. The artificial lift system of claim 15, wherein a frequency of the acoustic waves is in a range of 10 kHz-2 MHz.

24. An artificial lift system for deliquification of gas production wells including a wellbore receiving reservoir fluids from a producing zone of a subterranean reservoir, the reservoir fluids comprising gas and liquid, wherein the liquid comprise hydrocarbon, water and mixtures thereof in a liquid column at the bottom of the wellbore, and wherein the wellbore comprises a production tubing or a casing in the wellbore with a plurality of perforations for gas to flow from the reservoir up the production tubing or casing for subsequent recovery, the system comprising:

(a) a downhole tool for placement down the production tubing or casing in the wellbore, the downhole tool comprising:

(i) an atomizing chamber for conversion of the liquid in the atomizing chamber into droplets having an average diameter less than or equal to 10,000 microns, wherein the atomizing chamber is in fluid communication with the liquid in the wellbore during operation to provide the liquid to the atomizing chamber, and wherein the atomizing chamber is located above the liquid column during operation to facilitate exit of the droplets from the atomizing chamber for the transport of the droplets via the gas flow up the production tubing or casing, and wherein the atomizing chamber comprises a plurality of atomizers, and wherein each atomizer comprises a piezoelectric acoustic transducer, and wherein each piezoelectric acoustic transducer comprises one or more piezoelectric crystals for driving a rotating or vibrating surface to generate an acoustic wave that convert the liquid in the atomizing chamber into the droplets;

(b) a conductive cable for connection to the downhole tool;

(c) power supply for providing power to the downhole tool through the conductive cable; and (d) a pump partially or fully submerged in the liquid column for feeding the liquid into the atomizing chamber;

wherein the acoustic wave is generated with the atomizing chamber, and wherein the acoustic wave generated by the atomizing chamber has a frequency in an ultrasonic spectrum;

wherein the liquid is vaporized within the atomizing chamber through vibration of the liquid by the acoustic wave emitted within the atomizing chamber, wherein vaporizing the liquid converts that liquid into the droplets;

wherein the droplets that exit the atomizing chamber are transported to a well surface by the gas flow up the production tubing or casing.

25. The artificial lift system of claim 24, wherein each atomizer comprises the piezoelectric acoustic transducer and an acoustic horn.

26. The artificial lift system of claim 24, further comprising at least a location detection device for detection of liquid level in the wellbore.

27. The artificial lift system of claim 24, wherein a frequency of the acoustic waves is in a range of 10 kHz-2 MHz.

* * * * *